United States Patent [19]

Courtwright

[11] 4,036,542

[45] July 19, 1977

[54] KNOCK-DOWN DRAWER CONSTRUCTION

[75] Inventor: Robert M. Courtwright, Tacoma, Wash.

[73] Assignee: Hauserman, Inc., Tacoma, Wash.

[21] Appl. No.: 638,537

[22] Filed: Dec. 8, 1975

[51] Int. Cl.[2] ..... A47B 47/00; A47B 43/00

[52] U.S. Cl. ..... 312/330 R; 312/263

[58] Field of Search ..... 312/330, 257, 263, 347; 52/696

[56] References Cited

U.S. PATENT DOCUMENTS

| | | | |
|---|---|---|---|
| 2,118,525 | 5/1938 | Richardson | 312/330 |
| 2,803,511 | 8/1957 | Nordsieck | 312/263 |
| 2,945,270 | 7/1960 | Schaefer | 312/263 |
| 3,195,968 | 7/1965 | Freeman | 312/263 |
| 3,363,960 | 1/1968 | Reiss et al. | 312/347 |
| 3,458,242 | 7/1969 | Williams | 312/263 |
| 3,565,503 | 2/1971 | Aschinger et al. | 312/263 |

*Primary Examiner*—Casmir A. Nunberg

*Attorney, Agent, or Firm*—Seed, Berry, Vernon & Baynham

[57] ABSTRACT

A knock-down drawer construction held together by resilient clamps. A pair of front clamps, U-shaped in cross section, are fastened to the rear face of the drawer front by threaded fasteners, such as screws or bolts, and the sides of the drawer are inserted into the clamps. Longitudinal slots along the inside faces of the sides support the drawer bottom, and the drawer bottom is retained in position by the drawer back which is fastened to the sides by corner clamps. The clamps are retained in position by integrally formed tabs which are inserted in transverse grooves on the outer faces of the drawer sides. Clearance recesses along the front edges of the drawer sides are formed adjacent each threaded fastener so that the major portion of the front edges may abut the clamps. The front clamps extend along the full length of the front edge, and notches formed in the clamps adjacent the longitudinal slots allow the bottom to extend forward of the clamps to abut the drawer front.

7 Claims, 6 Drawing Figures

FIG. 3
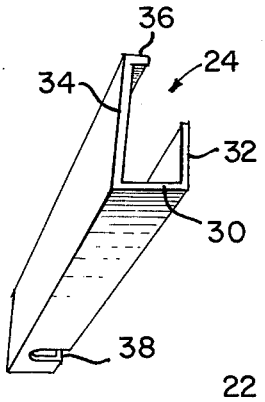
FIG. 4
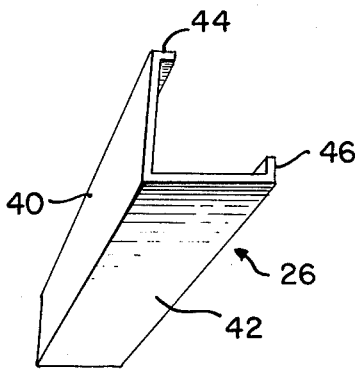
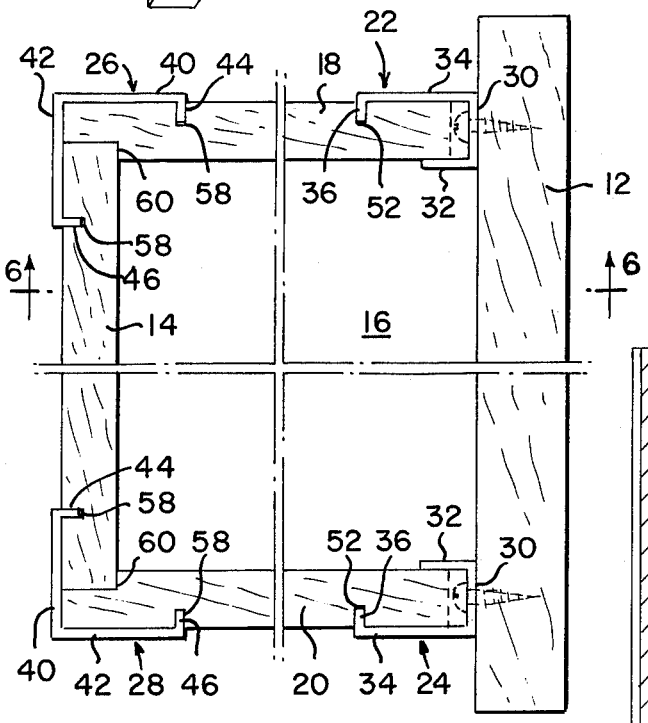
FIG. 5
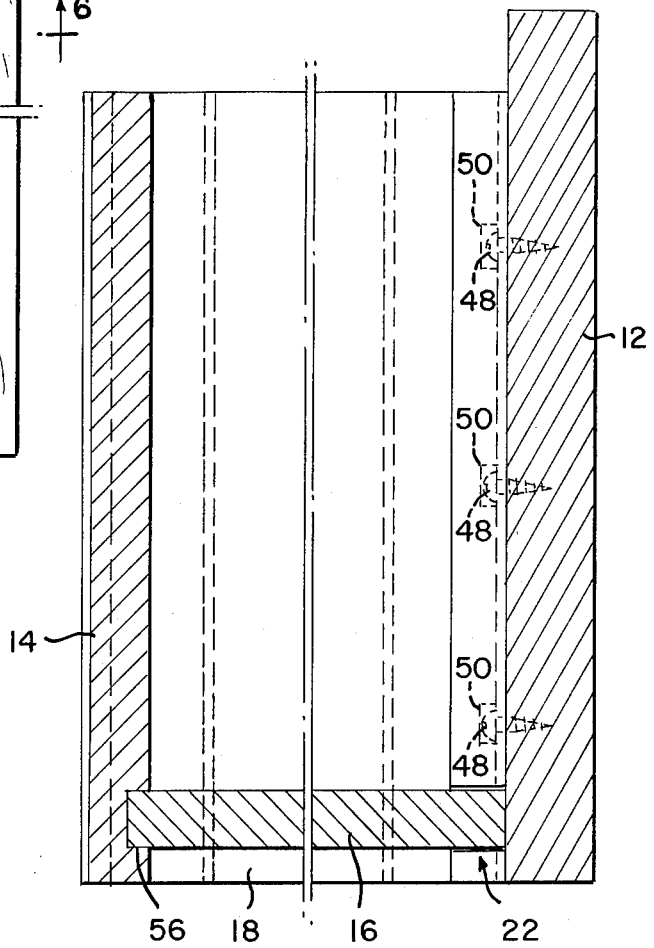
FIG. 6

KNOCK-DOWN DRAWER CONSTRUCTION

BACKGROUND OF THE INVENTION

1. Field of the Invention

This invention relates to drawer constructions and, more particularly, to a knockdown drawer construction which allows rapid disassembly and reassembly of the drawer.

2. Description of the Prior Art

Various types of knock-down drawer constructions are conventionally used in order to reduce shipping costs of furniture. The furniture may be shipped from the factory in a compact state and assembled at the place of use. Subsequently, the furniture may be disassembled for compact shipment and/or storage and quickly reassembled when the furniture is to be reused.

conventional knock-down construction techniques have been applied to drawers, but these existing drawers generally lack the sturdiness of conventional furniture, and the fastening structures they employ often cause the drawers to be unattractive in appearance.

SUMMARY OF THE INVENTION

It is an object of this invention to provide a knock-down drawer construction which is extremely sturdy.

It is another object of this invention to provide a knock-down drawer construction which is easily disassembled and reassembled without using specialized tools.

It is still another object of this invention to provide a knock-down drawer construction which is attractive in appearance, and which outwardly appears to be constructed using conventional furniture manufacturing techniques.

These and other objects of the invention are accomplished by a drawer construction in which the drawer components are held together by flexible clamps. The front clamps are generally U-shaped in cross section, and are fastened to the front of the drawer by threaded fasteners which project rearwardly from the clamp. The front edges of the drawer sides contain recesses adjacent each threaded fastener for receiving the projecting portion of the threaded fastener so that the major portion of the front edges may abut the front clamp thus increasing the strength of the unit. The inside faces of the drawer sides contain a longitudinal slot for receiving the drawer bottom. The front clamps, which extend along the full length of the front edges of the drawer sides, contain a notch adjacent the slots so that the drawer bottom can extend forwardly beyond the front clamps to abut the drawer front. The bottom is retained in position by the drawer back. The drawer bottom, by contacting all of the other drawer components, maintains the rectangular shape of the drawer.

BRIEF DESCRIPTION OF THE DRAWINGS

FIG. 3 is an isometric view of a front clamp.

FIG. 4 is an isometric view of a rear corner clamp.

FIG. 5 is a top plan view of the assembled drawer utilizing the knock-down drawer construction.

FIG. 6 is a side cross-sectional view of the drawer construction taken along the line 6—6 of FIG. 5.

DETAILED DESCRIPTION OF THE INVENTION

Figure 1:
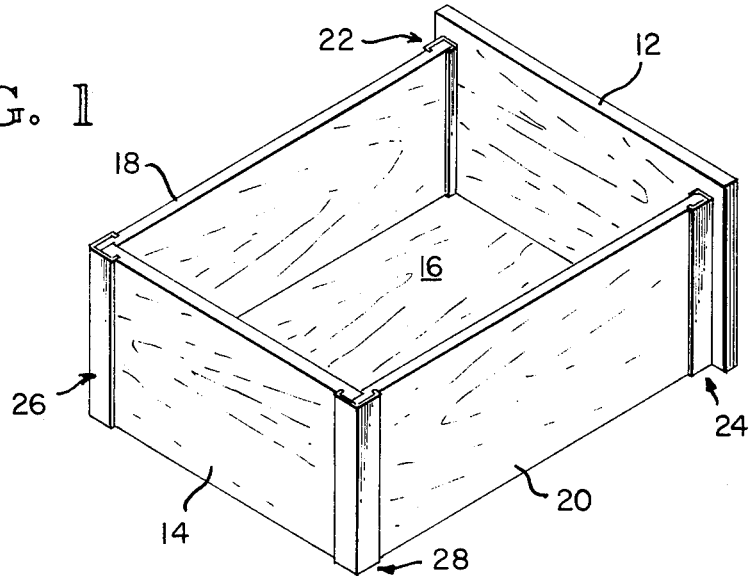
FIG. 1 is an isometric view of the assembled drawer utilizing the knock-down construction.

A drawer utilizing the inventive knock-down construction is shown as assembled in FIG. 1. The drawer components include a drawer front 12, a back 14, a bottom 16, and two sides 18, 20. The sides 18, 20 are fastened to the front 12 by a pair of front clamps 22, 24, and the sides 18, 20 are connected to the back 14 by rear corner clamps 24, 26. As illustrated in greater detail by rear corner clamps 24, 26. As illustrated in greater detail in FIG. 3, the front clamp 24 is generally U-shaped in cross section and includes a center leg 30, an inner leg 32, and an outer leg 34. The outer leg 34 terminates in a short, inwardly extending tab 36 which, as will be explained hereinafter, fits into a vertical groove on the outer face of the drawer side 20. The lower end of the inner leg 32 contains a transverse slot 38 for a purpose to be explained below.

The corner clamp 28 as illustrated in greater detail in FIG. 4, is generally V-shaped in cross section and includes a pair of legs 40, 42 meeting each other at a right angle. The legs 40, 42 terminate in inwardly extending tabs 44, 46, respectively, which are inserted into vertical grooves on the outer faces of the back 14 and side 20, respectively. All of the clamps 22, 24, 26, 28 are of a resilient material, preferably extruded plastic. However, clamps made from other materials or formed by different procedures may also be used.

Figure 2:
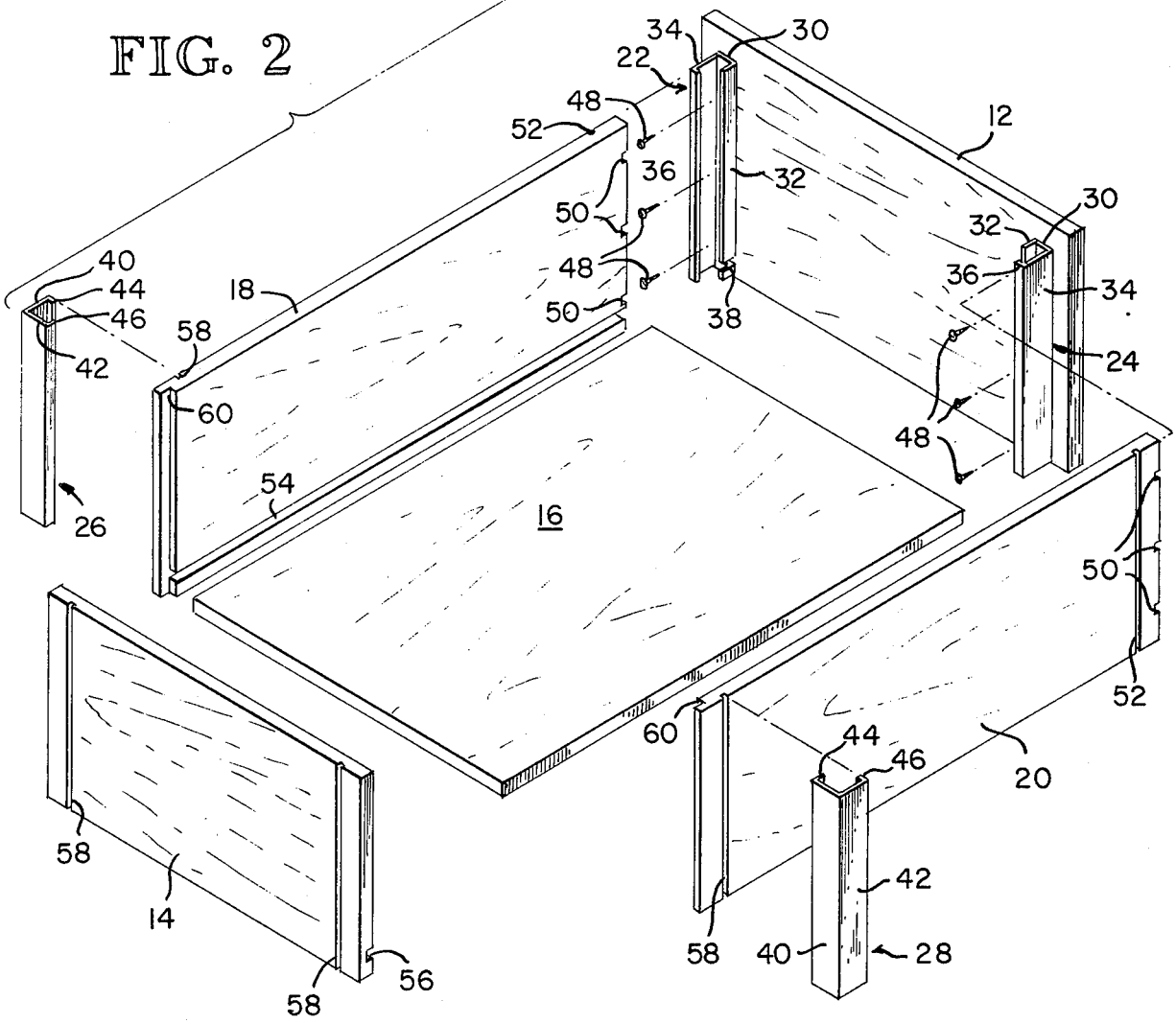
FIG. 2 is an exploded isometric view of the knock-down drawer construction.

The knock-down drawer construction is best illustrated in the exploded view of FIG. 2. The front clamps 22, 24 are fastened to the rear face of the drawer front 12 by threaded fasteners such as screws 48 which extend through the center legs 30 of the clamps 22, 24 into the drawer front 12. The heads of the screws 48 protrude rearwardly behind the center legs 30 as best illustrated in FIG. 6. Recesses or notches 50 are formed on the forward edges of the sides 18, 20 adjacent each screw 48 to provide sufficient clearance so that the screws 48 do not prevent the forward edges of the sides 18, 20 from abutting the rear face of the center legs 30. Although notches 50 extending the width of the sides 18, 20 are illustrated, it is understood that other recesses, such as circular apertures, may also be used. Since virtually the entire forward edges of the sides 18, 20 abut the center legs 30 of the clamps 22, 24 the joints between the sides 18, 20 and the front 12 are substantially stronger than they would be if the edges abutted only the heads of the screws 48.

With reference also to FIG. 5, the sides 18, 20 are inserted into the U-shaped front clamps 22, 24 so that the forward edges thereof abut the rear face of the center legs 30, and the tabs 36 at the ends of the outer legs 34 fit into vertical grooves 52 adjacent the forward ends of the sides 18, 20. Since the clamps 22, 24 are resilient, the outer legs 34 are able to bend outwardly so that the tabs 36 slide along the outer faces of the sides 18, 20 and spring into place in the grooves 52 when the forward edges of the sides 18, 20 abut the center legs 30. A longitudinal slot 54 is formed along the lower edge of each of the sides 18, 20 for slidably receiving the bottom 16. The notches 38 in the inner legs 32 of the clamps 22, 24 are positioned adjacent the slots 54 so that the bottom 16 may extend the full length of the sides 18, 20 with the forward edge abutting the rear face of the drawer front 12. The notches 38 by allowing the entire front edge of the bottom 16 to abut the drawer front 12 causes the drawer to be substantially stronger than it would be if the forward edge of the bottom abutted only the clamps 22, 24. Since the drawer bottom 16 contacts all of the other drawer components the rectangular bottom 16 maintains the rectangular shape of the drawer.

The rear edge of the bottom 16 is received by a slot 56 as best illustrated in FIG. 6. The back 14 which is clamped to the sides 18, 20 by rear corner clamps 26, 28 holds the bottom 16 securely in position against the drawer front 12. The tabs 44, 46 of the corner clamps 26, 28, respectively, are inserted into vertical grooves 58 which maintain the clamps 26, 28 in position against the corners. The inside faces of the sides 18, 20 adjacent the rear ends are notched at 60 to receive the ends of the drawer back 14 to provide additional strength at the junction between the sides 18, 20 and back 14.

When the drawer is to be assembled, the front clamps 22, 24 are fastened to spaced apart points on the rear face of the drawer front 12 by screws 48. The sides 18, 20 are then inserted into the front clamps 22, 24, respectively, with the outer legs 34 sprung outwardly so that the tabs 36 slide along the outer faces of the sides 18, 20. When the sides 18, 20 are fully inserted so that the front edges thereof abut the rear face of the center legs 30, the tabs 36 snap into the grooves 52 and securely hold the sides 18, 20 against the front 12. The bottom 16 is then inserted into the slots 54 past the notches 38 in the inner legs 32 of the front clamps 22, 24 until the forward edge of the bottom 16 abuts the drawer front 12. Finally, the drawer back 14 is placed against the drawer sides so that the ends thereof fit into the notches 60 and the rear edge of the drawer bottom 16 fits into the slot 56. The drawer back 14 is then secured in place by clamps 26, 28. When the drawer is to be disassembled, the above steps are repeated in reverse order. In this manner the drawer can be repeatively disassembled and reassembled an unlimited number of times. The drawer bottom 16 abutting the sides 18, 20 front 12 and back 14 maintains the strength and rectangular shape of the drawer, and further strength is provided by both edges of the sides 18, 20 abutting the front 12 and back 14. The resiliency of the clamps 22, 24, 26, 28 holds all of the drawer components solidly together to provide a sturdy drawer construction as in a conventional drawer construction where the drawer elements are glued to each other. Since the clamps 22, 28 are hidden from view when the drawer is closed the drawer is as attractive as a conventionally-constructed drawer.

The embodiments of the invention in which a particular property or privilege is claimed are defined as follows:

1. A knock-down drawer construction comprising:

a drawer front;

a pair of resilient front clamps, generally U-shaped in cross section, each clamp having a center leg, an inner leg, and an outer leg, said clamps being fastened to the rear face of said drawer front at spaced apart points thereof by threaded fasteners each of which extend through said center legs and engage said drawer front, said fasteners having a head projecting rearwardly beyond the rear face of said center leg, said clamps further including inwardly extending tabs along the vertical edges of said outer legs;

a pair of drawer sides, each side having its forward end received by one of said front clamps with the tabs of each clamp inserted in a vertical groove on the outer face of the respective drawer side, the inner faces of said drawer sides containing a longitudinal slot adjacent the lower edges thereof which extend the full length of said side, the forward edges of said sides having recesses formed therein adjacent the rearwardly projecting heads of said fasteners, said recesses being of sufficient depth to accommodate the projecting portion of said fasteners such that said clamps receive said drawer sides with the major portion of the forward edges thereof abutting the center legs of said clamps.

2. The drawer construction of claim 1, wherein each of said recesses comprises a uniform slot extending from one face of the said drawer side to the opposite face thereof.

3. A knock-down drawer construction comprising:

a drawer front;

a pair of drawer sides, each side having a vertical groove on the forward portion of its outer face, the inner faces of said drawer sides containing a longitudinal slot adjacent the lower edges thereof which extend the full length of said side;

a drawer bottom received in said slots with the forward edge thereof abutting the rear face of said drawer front;

a drawer back extending between the rear ends of said drawer sides and being fastened thereto by corner clamps having a pair of inwardly extending, vertical tabs inserted into vertical grooves in said back and sides, respectively, adjacent the junctions therebetween; and a pair of resilient front clamps, generally U-shaped in cross section receiving the forward ends of said drawer sides, each clamp having a center leg, an inner leg, and an outer leg, said clamps being fastened to the rear face of said drawer front at spaced apart points thereof by threaded fasteners which extend through said center legs and engage said drawer front, said clamps further including inwardly extending tabs along the vertical edges of said outer legs which are inserted in the vertical grooves on the forward portion of the outer faces of said sides, the inner legs of said clamps containing a notch adjacent said longitudinal slots such that said drawer bottom may extend beyond the rear edges of said front clamps to abut the rear face of said drawer front.

4. In a knock-down drawer construction having a drawer front secured to a pair of drawer sides by resilient front clamps, generally U-shaped in cross section, each of said clamps having a center leg, a inner side leg, and an outer side leg, said clamps being fastened to the rear face of said drawer front at spaced apart points by threaded fasteners passing through the centers legs of said clamps and engaging said drawer front, each of said threaded fasteners having a head projecting rearwardly from the rear faces of said center legs, the improvement comprising clearance recesses in the forward edges of said drawer sides adjacent said threaded fasteners, said recesses having a depth greater than the distance that said threaded fasteners project rearwardly from the rear faces of said center legs such that said clamps may receive said drawer sides with the major portion of the forward edges thereof abutting the center legs of said clamps.

5. The drawer construction of claim 4, wherein each of said clearance recesses comprise a uniform slot extending from one face of said drawer side to the opposite face thereof.

6. In a knock-down drawer construction having a drawer front secured to a pair of drawer sides by resilient front clamps extending along the full height of said drawer sides, said clamps being generally U-shaped in cross section and having inner, center, and outer legs, the inside face of each drawer side containing a longitudinal slot which receive a drawer bottom, the improvement comprising a notch in the inside leg of each front clamp adjacent said longitudinal slots such that said drawer bottom may extend forwardly beyond the rear edges of said front clamps to abut the rear face of said drawer front.

7. The drawer construction of claim 6, wherein said drawer bottom is locked in place by a drawer back fastened to the rear ends of said drawer sides by a pair of resilient corner clamps.

* * * * *